US005836297A

United States Patent [19]

Kawasaki

[11] Patent Number: 5,836,297

[45] Date of Patent: Nov. 17, 1998

[54] COOKING EXHAUST APPARATUS AND METHOD OF INSTALLING THE APPARATUS

[76] Inventor: Tomeji Kawasaki, 30-12, Hibaru 7-chome, Minami-ku, Fukuoka-shi, Fukuoka, Japan

[21] Appl. No.: 960,708

[22] Filed: Oct. 30, 1997

Related U.S. Application Data

[63] Continuation of Ser. No. 466,764, Jun. 6, 1995, abandoned.

[30] Foreign Application Priority Data

Dec. 9, 1994 [JP] Japan ..... 6-306629
Mar. 13, 1995 [JP] Japan ..... 7-052603

[51] Int. Cl.[6] ..... F23L 3/00

[52] U.S. Cl. ..... 126/299 D; 126/299 R; 126/299 E; 126/299 F; 126/300; 126/312

[58] Field of Search ..... 126/299 D, 299 E, 126/299 F, 299 R, 300, 312

[56] References Cited

U.S. PATENT DOCUMENTS 3,400,649 9/1968 Jensen ..... 126/300
3,530,784 9/1970 Courchesne ..... 126/300 X
4,436,023 3/1984 Takahashi ..... 126/299 D X
5,154,161 10/1992 Rogers et al. ..... 126/299 D X

*Primary Examiner*—Larry Jones
*Attorney, Agent, or Firm*—James Ray & Associates

[57] ABSTRACT

The invention aims to achieve a strong low-noise exhaust from a smoke collecting hood disposed right above a gas range on a cooking table through a piping in a ceiling in a high-rise apartment house or a detached house. The cooking table is provided on a floor, and the smoke collecting hood is disposed right above the gas range placed on the cooking table and is connected to the piping in the ceiling. The piping is connected to one side of a box-like hollow member provided on an outer surface of an external wall of the house, and a drawing port of an exhaust blower is connected to another side of the box-like hollow member so that the space through which the piping and the drawing port face each other is maximized. The box-like hollow member is formed so that its inside diameter is larger than the inside diameters of the drawing port and the piping.

13 Claims, 7 Drawing Sheets

COOKING EXHAUST APPARATUS AND METHOD OF INSTALLING THE APPARATUS

CROSS-REFERENCE TO RELATED APPLICATIONS

This application is a continuation of patent application Ser. No. 08/466,764, filed Jun. 6, 1995, now abandoned.

BACKGROUND OF THE INVENTION

1. Field of the Invention

The present invention relates to exhaust equipment and, more particularly, to house cooking exhaust installation and a method of installing the exhaust equipment.

2. Description of the Related Art

A conventional cooking installation in high-rise apartment houses is arranged in such a manner that an exhaust blower and a smoke collecting hood are provided right above a cooking gas range, the blower is connected through the smoke collecting hood to an end of an exhaust pipe such as a polyvinyl chloride pipe laid in the ceiling, and the other end of the exhaust pipe has an opening in an external wall (which may be a wall facing the outside through a verandah). This opening is used as an exhaust port through which smoke or the like is discharged.

The above-mentioned exhaust blower, located right above the cooking table gas range, draws smoke and the like through the smoke collecting hood, and blows it into the small-diameter exhaust pipe in the ceiling to discharge it to the outside through the exhaust port in the external wall.

On the other hand, an apparatus has been proposed which has an upward-facing hood provided at the rear of a gas range instead of the above-mentioned smoke collecting hood, in which the exhaust in the hood is drawn through a drawing duct by a drawing blower provided outside the house, and in which a negative pressure is created in the drawing duct to increase the drawing force while blower noise in the cookroom is reduced.

The drawing duct of such an apparatus, however, has such a large inside diameter that it cannot be made in the ceiling after the construction of the house. Also, such an apparatus has not been used in high-rise apartment houses under restrictions by the structure of such apartments in which only one boundary slab is provided between adjacent stories.

An idea has then been proposed of providing an exhaust blower on an external wall of a high-rise apartment house to create a negative pressure in an exhaust pipe in the ceiling so that the force of drawing exhaust smoke into a smoke collecting hood is increased. However, substantially no improvement in drawing force has experimentally been recognized with respect this idea.

SUMMARY OF THE INVENTION

An object of the present invention is to provide a cooking exhaust installation provided in a high-rise apartment house or a detached house to effect strong low-noise exhaust from a smoke collecting hood located right above a heating unit through a piping in a ceiling.

Another object of the present invention is to provide a method for enabling the above-mentioned installation to be installed easily.

To achieve these objects, according to a general aspect of the present invention, there is provided a cooking exhaust apparatus for use in a cookroom defined by a floor, a ceiling and a side wall, the apparatus comprising a heating unit, a smoke collecting hood provided right above the heating unit, a piping laid in the ceiling, the piping having two ends through one of which it communicates with the smoke collecting hood, a hollow member having a first portion connected to the other end of the piping, the hollow member being attached to the side wall, and an exhaust blower having a drawing port connected to a second portion of the hollow member separate from the first portion to which the piping is connected, wherein the hollow member has an inside dimension substantially larger than an inside diameter of the drawing port and an inside diameter of the piping.

In a preferred embodiment of the invention, the hollow member is formed of a plurality of side surfaces so as to have a box-like shape and is attached to an external surface of the side wall, one of the side surfaces including the first portion, another of the side surfaces including the second portion. The first portion is shifted from a center of the side surface to which the piping is connected so that a large space is defined between the first and second portions in the hollow member. The hollow member is provided inside the side wall instead of being provided on the outside of the side wall.

Preferably, the cooking exhaust apparatus further comprises a cooking table provided on the floor of the cookroom, and the heating unit is a gas range or an oven range placed on the cooking table. The oven range may be of a gas type or an electric type. A scirocco fan is preferably used as the exhaust blower.

Preferably, a drawing through hole for drawing air in the cookroom is formed in a wall portion of the smoke collecting hood. Also, the smoke collecting hood and the piping are connected by a vertical duct, and it is advantageous to also form a drawing through hole for drawing air in the cookroom in a wall portion of the vertical duct. Preferably, an openable lid is provided at least at the drawing through hole formed in the vertical duct.

A metallic flame extinguishing device is provided in the smoke collecting hood. Preferably, the metallic flame extinguishing device is formed of a plurality of louver-like vent guide plates which partition the interior of the smoke collecting hood.

According to another aspect of the present invention, there is provided a method of installing a cooking exhaust apparatus comprising the steps of removing an already-installed exhaust blower disposed right above a cooking table provided on a floor while an already-installed hood in which the already-installed blower has been provided and an already-installed piping in a ceiling are left, connecting an opening of the piping on an external wall side to one side of a box-like hollow member having an inside dimension substantially larger than an inside diameter of the piping, and connecting a drawing port of the exhaust blower having an inside diameter substantially smaller than the inside dimension of the box-like hollow member to another side of the box-like hollow member so that a space formed between the piping and the drawing port of the blower is maximized.

According to a still another aspect of the present invention, there is provided a method of installing a cooking exhaust apparatus comprising the steps of removing an already-installed exhaust blower disposed right above a cooking table provided on a floor while an already-installed hood in which the already-installed blower has been provided and an already-installed piping in a ceiling are left, connecting an opening of the piping on an external wall side to a first portion of a box-like hollow member having an inside dimension substantially larger than an inside diameter of the piping, and connecting a drawing port of the exhaust blower having an inside diameter substantially smaller than the inside dimension of the box-like hollow member to a second portion of the box-like hollow member separate from the first portion so that a space formed between the piping connected to the first portion and the drawing port of the blower connected to the second portion is maximized.

Preferably, in the above-described installation method, the already-installed hood is also removed along with the already-installed exhaust blower, and a newly-installed hood is placed in the space from which the already-installed hood has been removed, and is connected to the already-installed piping in the ceiling.

According to the present invention, when the exhaust blower is rotated by turning on the switch after igniting the gas range on the cooling table and after placing a cooking pan or grill, air in the box-like hollow member is drawn through the drawing portion that is open in the other side of the box-like hollow member, and cooking smoke above the gas range is thereby drawn into the smoke collecting hood to be discharge to the outside. The discharge blower first draws air in the box-like member through the drawing port so that a negative pressure is created in the box-like hollow member. This negative pressure causes air to flow continuously from the piping into the box-like hollow member against the flow resistance in the piping. The exhaust blower acts mainly to continuously maintain the negative pressure in the box-like member at a level equal to or lower than a predetermined value. That is, the exhaust blower functions as a negative pressure receiver or a vacuum receiver.

The smoke collecting hood has a pyramid-like shape (FIGS. 7, 9) or a deformed pyramid-like shape (FIG. 2) and has an internal fire extinguishing multi-opening plate or louver-like vent guide plate, which can extinguish flame.

A hole for drawing air in the cookroom may be formed in the smoke collecting hood and/or the vertical duct to draw and discharge stagnant air or rising smoke existing on the ceiling side of the room.

When the above-described exhaust apparatus is installed, only the exhaust blower in the already-installed exhaust hood may be removed while the already-installed hood of the already-installed blower and the already-installed piping in the ceiling are left to use the already-installed hood. Alternatively, both the already-installed hood and the already-installed exhaust blower may be removed and a newly-installed exhaust hood may be attached in place of the old one to be connected to the already-installed piping in the ceiling.

DESCRIPTION OF THE PREFERRED EMBODIMENTS

Figure 1:
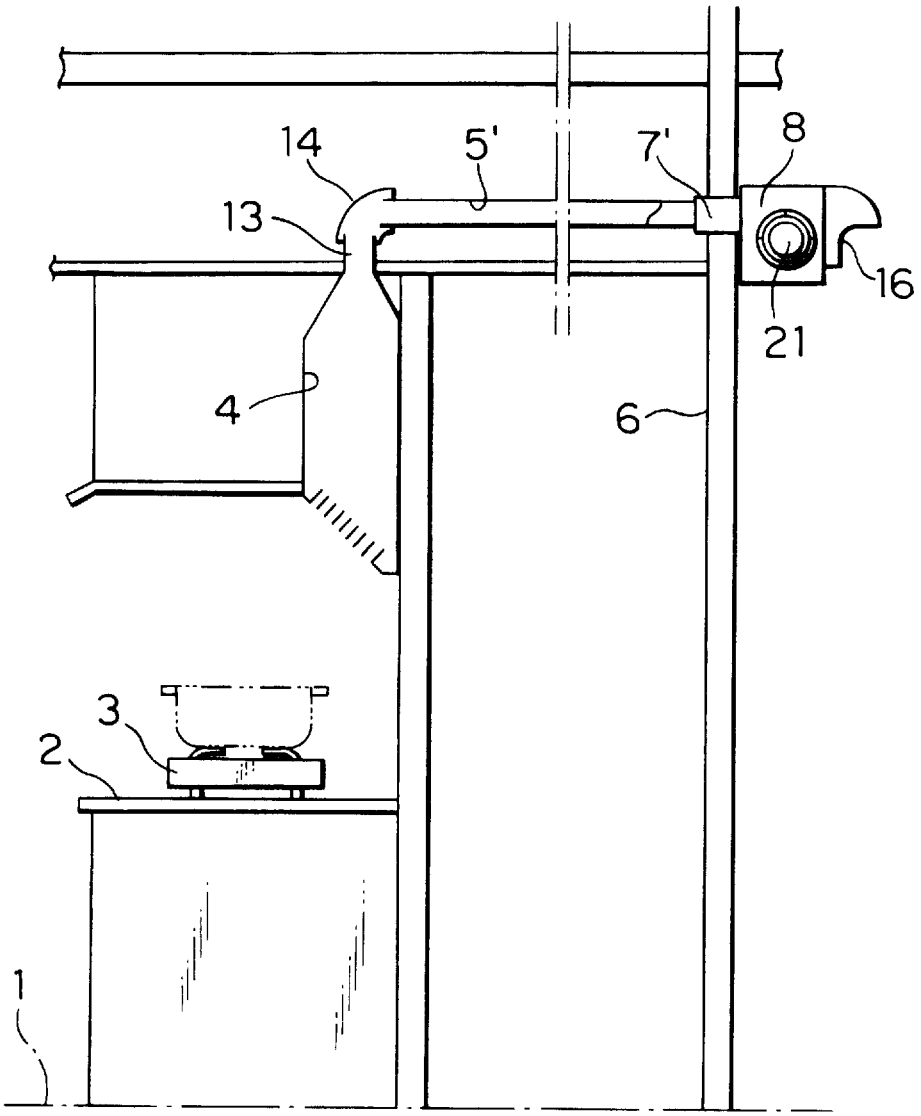
FIG. 1 is a side view of a cooking exhaust apparatus in accordance with the present invention.

Referring to FIG. 1, a cooking table 2 of an integrated kitchen system is provided on a floor 1 of a cookroom, and a heating unit such as a gas range 3 is provided on an upper surface of a cooking table 2. A newly-installed smoke collecting hood 4" is supported right above the gas range 3 with the lower end of the hood maintained at a height of, for example, about 60 cm from the gas range. A vertical duct 13 having a rectangular cross section is connected to the upper end of the hood 4" (see FIGS. 1 and 7), and the upper end of the upright duct 13 is connected to an already-installed piping 5' in a ceiling by a flexible elbow 14 through a duct/piping connection socket 15 (see FIG. 9). The structure of cooking table 2, gas range 3, hood 4", piping 5', duct 13, elbow 14, sockets 15 and other components may be the same as the corresponding conventional component and, therefore, will not be specially described. The heating unit may alternatively be a gas type or electric type oven range.

Figure 2:
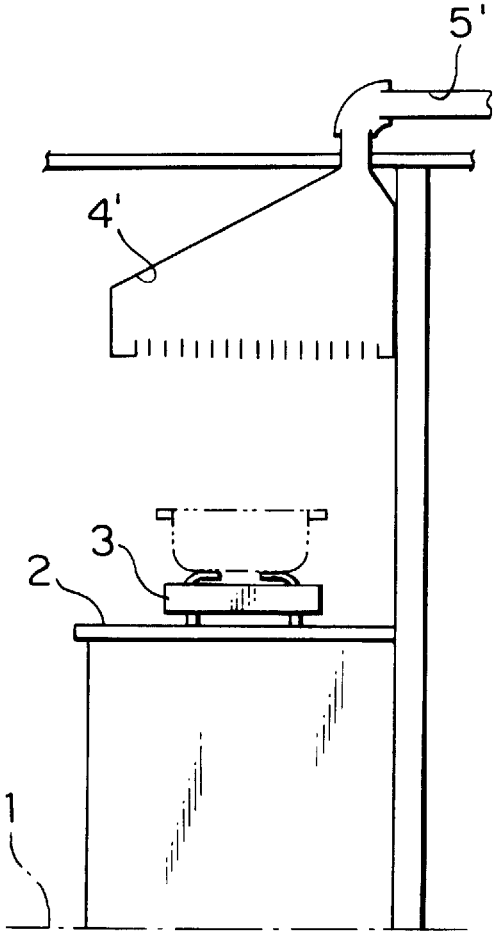
FIG. 2 is a side view of an already-installed hood.

It is, of course, preferable to use a newly-installed hood as smoke collecting hood 4". However, an already-installed hood having a deformed pyramid-like shape such as that indicated at 4' in FIG. 2 may also be used as smoke collecting hood 4". In such a case, an already-installed exhaust blower (not shown) provided inside the hood 4' connected to the already-installed piping 5' is removed.

Figure 3:
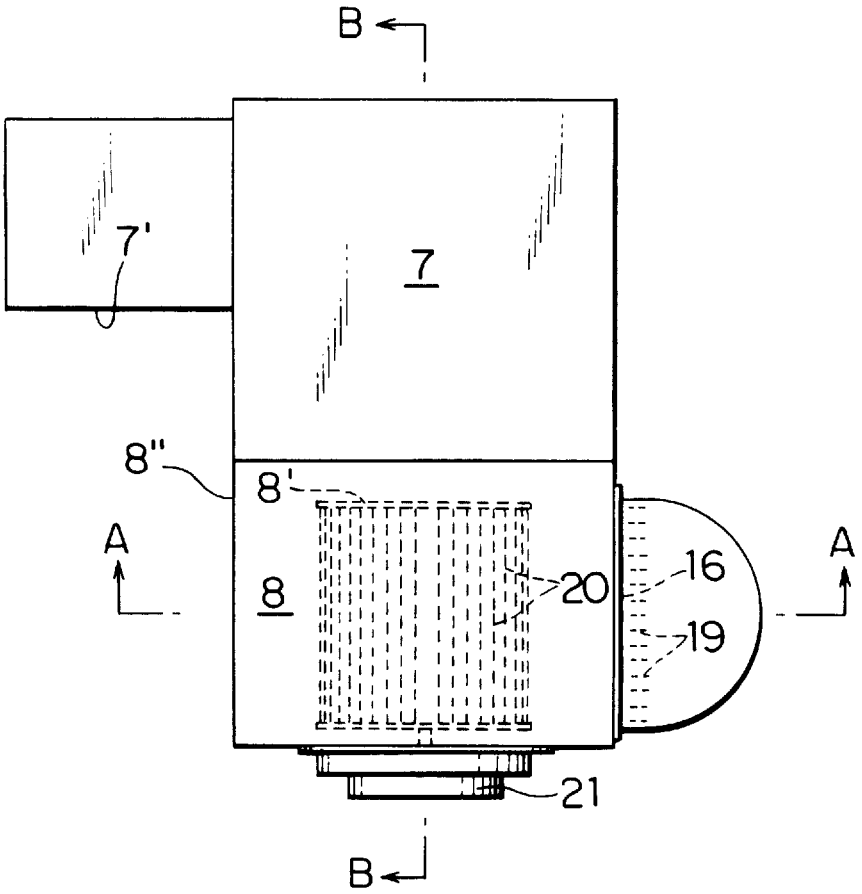
FIG. 3 is a plan view of a box-like hollow member and an exhaust blower.
Figure 4:
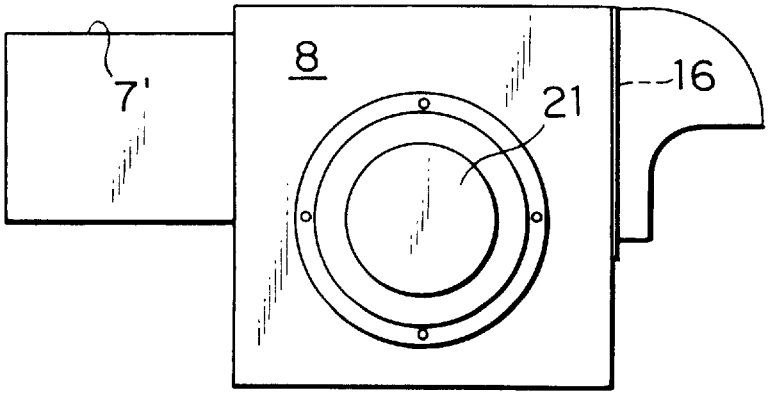
FIG. 4 is a front view of FIG. 3.
Figure 5:
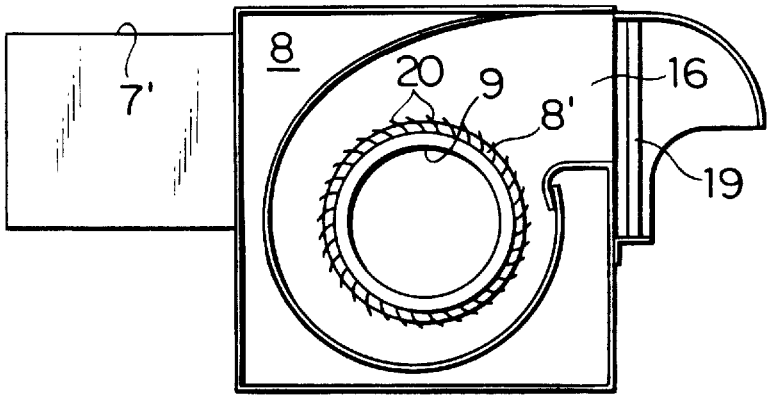
FIG. 5 is a longitudinal sectional front view taken along the line A—A of FIG. 3.

The ceiling piping 5' has an opening in an external surface of an external wall 6. That is, the piping 5' has its opening connected to one side of a box-like hollow member 7 (see FIGS. 3 and 4) fixed adjacent to the external surface of the external wall 6 by suitable means such as (not shown). The piping 5' may be a newly-installed pipe or an already-installed pipe 5 shown in FIG. 2. As shown in FIGS. 3 to 5, an inserted pipe 7' is provided on one side of the box-like hollow member 7 and is inserted into the piping 5' to connect the piping 5' and the box-like hollow member 7.

In a preferred embodiment of the present invention, the box-lIke hollow member 7 is substantially in the form of a regular hexahedron. The size of one face of the hollow member 7 (inside dimension) is substantially larger than the inside diameters of the ceiling piping 5' and the inserted pipe 7'. In the embodiment shown, the inside dimension of the hollow member 7 is more than twice as great as the diameter of either the ceiling piping 5' or the inserted pipe 7'. A casing 8" of an exhaust blower 8 is connected to an adjacent face of the box-like hollow member 7, as shown well in FIGS. 3 and 6. A cylindrical drawing port 9 of the exhaust blower 8 formed in the casing 8" is open in the box-like hollow member 7. Needless to say, the inside diameter of the drawing port is substantially smaller than the inside dimension of the box-like hollow member 7. In the embodiment shown, the inside dimension of the hollow member 7 is more than twice as great as the diameter of the drawing port 9.

An axial flow blower or a centrifugal blower may be used as exhaust blower 8. In this embodiment, a centrifugal type scirocco fan 8' is preferably used, as shown in FIGS. 3 to 6. However, axial flow propeller fan can also be used as exhaust blower 8.

Figure 6:
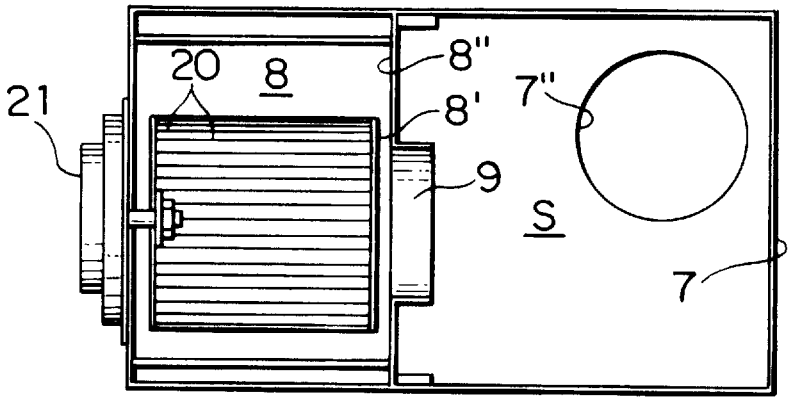
FIG. 6 is a longitudinal sectional side view taken along the line B—B of FIG. 3.

Between the inserted pipe 7' and the drawing port 9, a comparatively large space S is provided by connecting the inserted pipe 7' to a corner portion remote from the drawing port 9 as viewed in FIG. 6, i.e., by setting the inserted pipe 7' in a position eccentric from a center of the face of the box-like hollow member 7 in such a direction that the inserted pipe 7' is remote from the drawing port 9, thereby enabling the box-like hollow member 7 to be used as a negative pressure receiver or a vacuum receiver. Heating cooking smoke including exhaust smoke, vaporized oil and steam from cooked materials is drawn into the box-like hollow member 7 as a negative pressure or vacuum receiver against the flow resistance of the ceiling piping 5'. Only the drawn amount of smoke is discharged into the atmosphere through an exhaust port by the exhaust blower 8.

Figure 9:
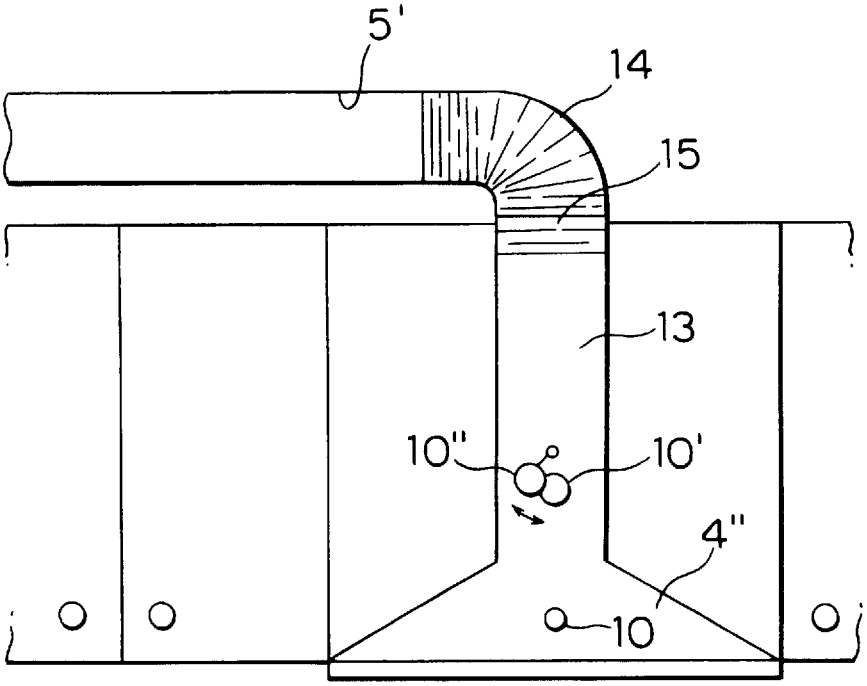
FIG. 9 is a front view of drawing holes formed in the hood and a rectangular duct.
Figure 10:
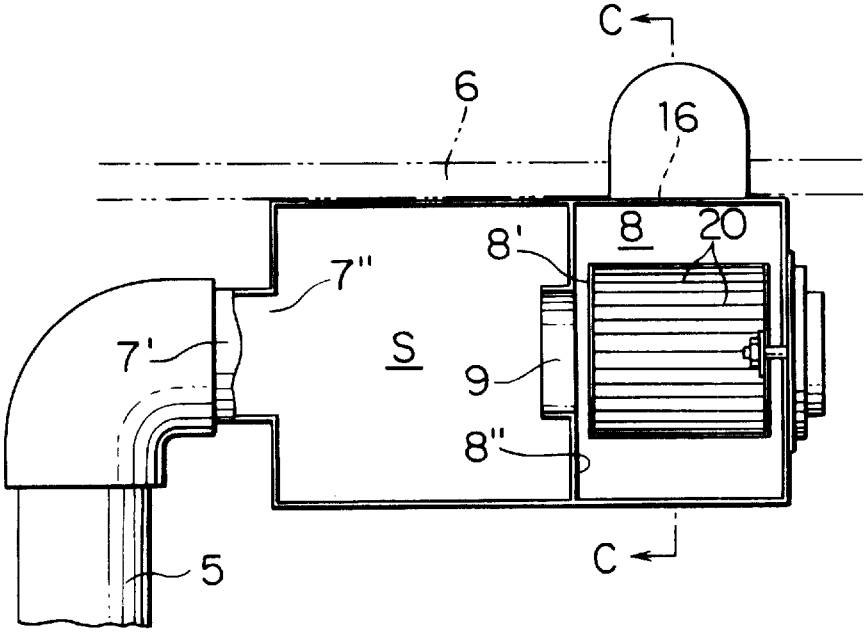
FIG. 10 is a partially-cutaway plan view of an embodiment of the invention in which a box-like hollow member is provided inside the external wall.
Figure 11:
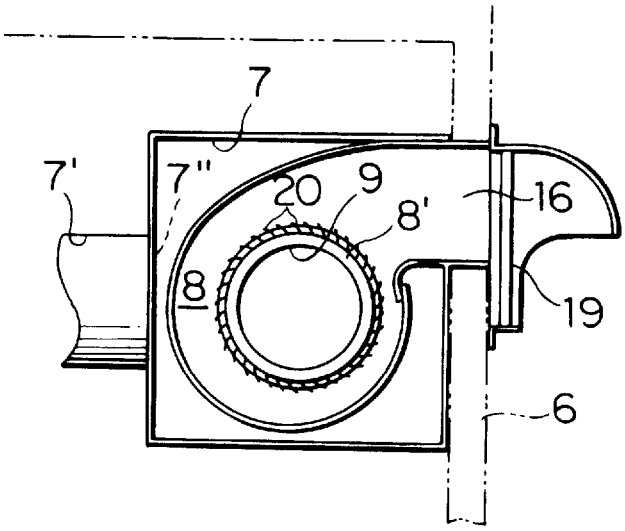
FIG. 11 is a longitudinal sectional side view taken along the line C—C of FIG. 10.
Figure 12:
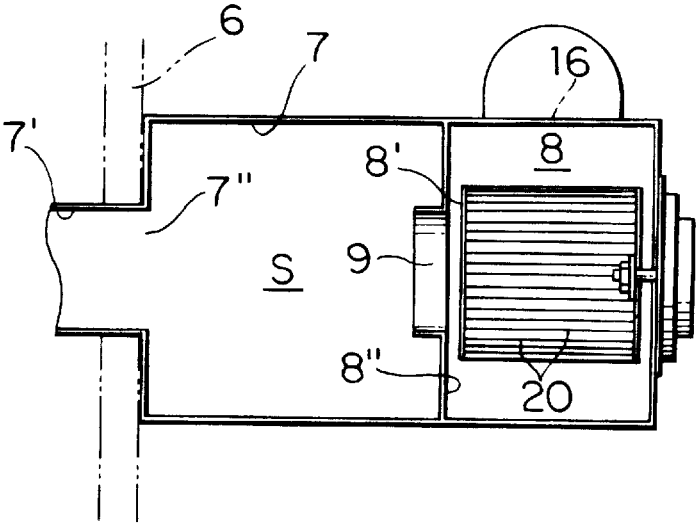
FIG. 12 is a transverse sectional plan view of an embodiment of the invention in which a box-like hollow member is provided outside the external wall.

With respect to the smoke collecting hood 4", it is advantageous to form, as shown in FIG. 9, a suitable number of room air drawing holes 10, 10' of a suitable size at suitable positions in the smoke collecting hood 4" and/or the interior vertical duct 13 connected to a top portion of the smoke collecting hood 4" in order to draw air, smoke or gas stagnating in the vicinity of the ceiling. If necessary, an openable lid 10" supported on a swingable arm is provided at the drawing holes 10, 10' (only at the hole 10' in this embodiment).

Figure 7:
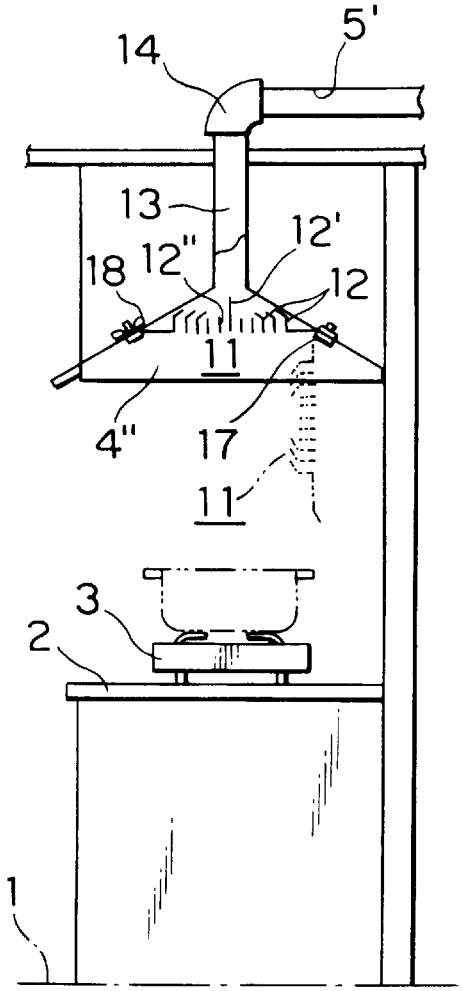
FIG. 7 is a longitudinal sectional side view of a smoke collecting hood having a flame extinguishing multi-opening metallic plate.
Figure 8:
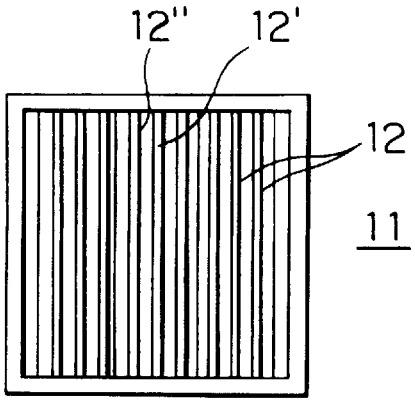
FIG. 8 is a plan view of a louver-like guide plate provided as the multi-opening plate shown in FIG. 7.

As shown in FIG. 7, a flame extinguishing multi-opening metallic plate device 11 in the form of a louver is detachably provided in the smoke collecting hood 4". This device 11 has a central guide plate 12' disposed at a center and extending linearly and upwardly through a comparatively large distance, comparatively-short intermediate guide plates 12" adjacently positioned on the opposite sides of the central guide plate 12', and outer guide plates 12 positioned outside the intermediate guide plates 12" and having upper end portions bent or curved toward the intermediate guide plates 12" or the central guide plate 12', whereby the drawn exhaust flow is directed along the newly-installed hood 4". The number, the length, the curvature and the intervals of these guide plates are selected as desired. The device 11 has one side portion axially supported on the hood 4" by a suitable means 17, and has an opposite side portion fixed to the hood 4" being fastened with butterfly screws 18.

Power supply wiring code (not shown) of the exhaust blower 8 is laid outside the ceiling piping 5' and is connected to a 100 V outlet in the room through a switch provided near the cooking table 2. Thus, the electric power supply wiring is laid away from the gas range 3.

FIGS. 1, and 3 to 6 also illustrate an animal guard provided in the hood-like exhaust port 16 of the exhaust blower 8, rotating vanes 20 of the scirocco fan 8', and a dive motor 21 of the exhaust blower, each of which is of a well-known type.

According to the present invention, as described above, an external wall opening of a ceiling piping connected to a smoke collecting hood provided in a cookroom is open in one side surface of a box-like hollow member which is provided on the external wall, and which has a dimension substantially larger than that of the piping, and an exhaust blower is connected to another side surface of the box-like hollow member and has a drawing port which has a diameter substantially smaller than a dimension of the box-like hollow member, and which communicates with the opening of the ceiling piping through a comparatively large space. In this arrangement, the negative pressure of the vacuum content in the box-like hollow member is increased by the exhaust blower so that cooking exhaust smoke is strongly drawn from the smoke collecting hood through the ceiling piping with reduced noise to be discharged to the outside.

There is no need for wiring an electric cable in the hood right above the gas range, and it is therefore possible to safely keep the power supply wiring away from cooking heat.

Because the exhaust blower is a scirocco fan, a sufficient air drawing force can be obtained effectively while reducing the size of the exhaust blower.

Air or smoke stagnating in the vicinity of the cookroom ceiling can be drawn and discharged through a room air drawing hole so that air in the vicinity of the cookroom ceiling can be clearly vent.

Flame which enters the smoke collecting hood is extinguished because the heat thereof is removed by the flame extinguishing multi-opening metallic plate, thereby achieving an improvement in safety. Also, rising cooking smoke flows upward while being dispersed and regulated by the louver-like vent guide plates and the central guide plate in the hood, thus achieving smooth passage of cooking smoke.

According to the above-described installation method of the present invention, an already-installed hood and an already-installed ceiling piping can be utilized only by removing an already-installed exhaust blower in the already-installed hood on the cookroom side.

Further, a newly-installed hood may be connected to an already-installed ceiling piping by removing an already-installed exhaust blower and an already-installed hood without performing piping work with respect to the already-installed ceiling piping, thus simplifying piping work in the ceiling.

What is claimed is:

1. A cooking exhaust apparatus for use in a cookroom defined by a floor, a ceiling and a side wall, said apparatus comprising:

a smoke collecting hood provided above a heating unit;

piping located in the ceiling, said piping having two ends through one of which it communicates with said smoke collecting hood;

a hollow member having a first wall portion connected to the other end of said piping, said hollow member being attached to the side wall of said cookroom;

an exhaust blower having a drawing port connected to a second wall portion of said hollow member separate and spaced from said first wall portion to which said piping is connected, said exhaust blower having an exhaust port discharging outside of said cookroom;

said hollow member having an inside dimension substantially larger than an inside diameter of said drawing port and substantially larger than an inside diameter of said piping; and said exhaust blower being operative to suck air through said drawing port thereof to cause a negative pressure in said hollow member, by which air in said piping is caused to flow into said hollow member against flow resistance of said piping, said exhaust blower drawing air through said hollow member providing a strong low-noise exhaust from said smoke collecting hood.

2. A cooking exhaust apparatus according to claim 1, wherein said hollow member is formed of a plurality of wall portions that provide side surfaces that provide a box-like shape and is attached to an external surface of the side wall of said cookroom, one of said side surfaces including said first wall portion, another of said side surfaces including said second wall portion, wherein said first wall portion is spaced from a center of the side surface to which said piping is connected so that a large space is provided between said first and second wall portions of the hollow member.

3. A cooking exhaust apparatus according to claim 1 wherein said hollow member is provided inside said side wall.

4. A cooking exhaust apparatus according to claim 1, wherein said exhaust blower comprises a scirocco fan.

5. A cooking exhaust apparatus according to claim 1 wherein a drawing through hole for drawing air in the cookroom is formed in a wall portion of said smoke collecting hood.

6. A cooking exhaust apparatus according to claim 1 wherein said smoke collecting hood and said piping are connected by a vertical duct, and a drawing through hole for drawing air in the cookroom is formed in a wall portion of said vertical duct.

7. A cooking exhaust apparatus according to claim 1 wherein said smoke collecting hood and said piping are connected by a vertical duct, and a drawing through hole for drawing air in the cookroom is formed in each of a wall portion of said vertical duct and a wall portion of said smoke collecting hood.

8. A cooking exhaust apparatus according to claim 7 wherein an openable lid is provided at least at said drawing through hole formed in said vertical duct.

9. A cooking exhaust apparatus according to claim 8 wherein a metallic flame extinguishing device is provided in said smoke collecting hood.

10. A cooking exhaust apparatus according to claim 9 wherein said metallic flame extinguishing device is formed of a plurality of louver-like vent guide plates which partition the interior of said smoke collecting hood.

11. A method of installing a cooking exhaust apparatus comprising the steps of:

removing an already-installed exhaust blower disposed above a cooking table while an already-installed hood in which the already-installed blower has been provided and an already-installed piping in a ceiling are left;

connecting an opening of the piping to one side of a box-like hollow member having an inside dimension substantially larger than an inside diameter of the piping; and connecting a drawing port of an exhaust blower having an inside diameter substantially smaller than the inside dimension of the box-like hollow member to another side of the box-like hollow member so that a space provided between the opening of said piping and the drawing port of the blower is maximized.

12. A method of installing a cooking exhaust apparatus comprising the steps of:

removing an already-installed exhaust blower disposed above a cooking table while an already-installed hood in which the already-installed blower has been provided and an already-installed piping in a ceiling are left;

connecting an opening of the piping to a first portion of a box-like hollow member having an inside dimension substantially larger than an inside diameter of the piping; and connecting a drawing port of an exhaust blower having an inside diameter substantially smaller than the inside dimension of the box-like hollow member to a second portion of the box-like hollow member separate from the first portion so that a space provided between the opening of said piping connected to the first portion and the drawing port of the blower connected to the second portion is maximized.

13. A method of installing a cooking exhaust apparatus according to claim 11 wherein the already-installed hood is also removed along with the already-installed exhaust blower, and a newly-installed hood is placed in the space from which the already-installed hood has been removed, and is connected to the already-installed piping in the ceiling.

* * * * *